US008230763B2

(12) United States Patent
Liu

(10) Patent No.: US 8,230,763 B2
(45) Date of Patent: Jul. 31, 2012

(54) BOTTLE OPENER FOR POLYETHYLENE TEREPHTHALATE BOTTLES

(76) Inventor: Chin-Sung Liu, Guishan Township (TW)

( * ) Notice: Subject to any disclaimer, the term of this patent is extended or adjusted under 35 U.S.C. 154(b) by 318 days.

(21) Appl. No.: 12/725,456

(22) Filed: Mar. 17, 2010

(65) Prior Publication Data

US 2011/0226093 A1 Sep. 22, 2011

(51) Int. Cl.

| | |
|---|---|
| ***B67B 7/14*** | (2006.01) |
| ***B67B 7/18*** | (2006.01) |
| ***B67B 7/44*** | (2006.01) |
| ***B25B 13/28*** | (2006.01) |

(52) U.S. Cl. ..... 81/3.44; 81/3.09; 81/97

(58) Field of Classification Search ..... 81/3.44, 81/97, 3.07, 3.08, 3.09, 3.4, 3.41, 90.1–90.3, 81/99

See application file for complete search history.

(56) References Cited

U.S. PATENT DOCUMENTS

| | | | | |
|---|---|---|---|---|
| 2,463,525 | A * | 3/1949 | Deming | 81/97 |
| 2,524,434 | A * | 10/1950 | Duket | 81/3.4 |
| 4,523,497 | A * | 6/1985 | Rosberg et al. | 81/3.44 |
| 5,261,263 | A * | 11/1993 | Whitesell | 72/409.19 |
| 6,679,138 | B2 * | 1/2004 | Battles et al. | 81/3.44 |
| 6,971,282 | B2 * | 12/2005 | Bathey | 81/3.44 |

* cited by examiner

*Primary Examiner* — David B Thomas

(57) ABSTRACT

A bottle opener for opening polyethylene terephthalate bottles is disclosed to include a base, an adapter pivotally mounted in the base and defining therein an open chamber, retainers coupled between the base and the adapter and adapted for moving the cap of a polyethylene terephthalate bottle, each retainer having a toothed portion at one lateral side and a bearing portion adjacent to the toothed portion for stopping against the ribbed rim of the cap of the polyethylene terephthalate bottle to be opened to move the cap away from the polyethylene terephthalate bottle when the user biases the base relative to the polyethylene terephthalate bottle after attachment of the adapter to the cap.

6 Claims, 8 Drawing Sheets

BOTTLE OPENER FOR POLYETHYLENE TEREPHTHALATE BOTTLES

BACKGROUND OF THE INVENTION

1. Field of the Invention

The present invention relates to a bottle opener and more particularly, to such a bottle opener, which enables a user to open polyethylene terephthalate bottles conveniently.

2. Description of the Related Art

Polyethylene terephthalate is a thermoplastic polymer resin intensively used in beverage, food and other liquid containers for the advantages of lightweight, leak-proof, robustness and recyclable. When exercising or participating an outdoor activity, people may use a polyethylene terephthalate bottle to carry drinking water. However, opening the cap of a polyethylene terephthalate bottle requires effort. An old person or young child may be unable to open the cap of a polyethylene terephthalate bottle.

SUMMARY OF THE INVENTION

The present invention has been accomplished under the circumstances in view. It is the main object of the present invention to provide a bottle opener, which enables the user to open the cap of a polyethylene terephthalate bottle conveniently.

To achieve this and other objects of the present invention, a bottle opener comprises a base, an adapter pivotally mounted in the base and defining an open chamber, and a plurality of retainers coupled between the base and the adapter and adapted for opening the cap of a polyethylene terephthalate bottle. The base has a plurality of first pivot holes. The adapter has a plurality of second pivot holes. Each retainer has a first pivot pin and a second pivot pin extended from the bottom side thereof and respectively pivotally coupled to one first pivot hole of the base and one second pivot hole of the adapter, a toothed portion disposed at one lateral side thereof and a bearing portion extended from one side of the toothed portion. The toothed portion and the bearing portion are suspending in the open chamber of the adapter. The toothed portion and bearing portion of each retainer are adapted for stopping against the ribbed rim of the cap of the polyethylene terephthalate bottle to be opened so that the cap can be away from the polyethylene terephthalate bottle when the user biases the base relative to the polyethylene terephthalate bottle after attachment of the adapter to the cap. Thus, the user can open a polyethylene terephthalate bottle with the bottle opener efficiently with less effort.

DETAILED DESCRIPTION OF THE PREFERRED EMBODIMENT

Figure 1:
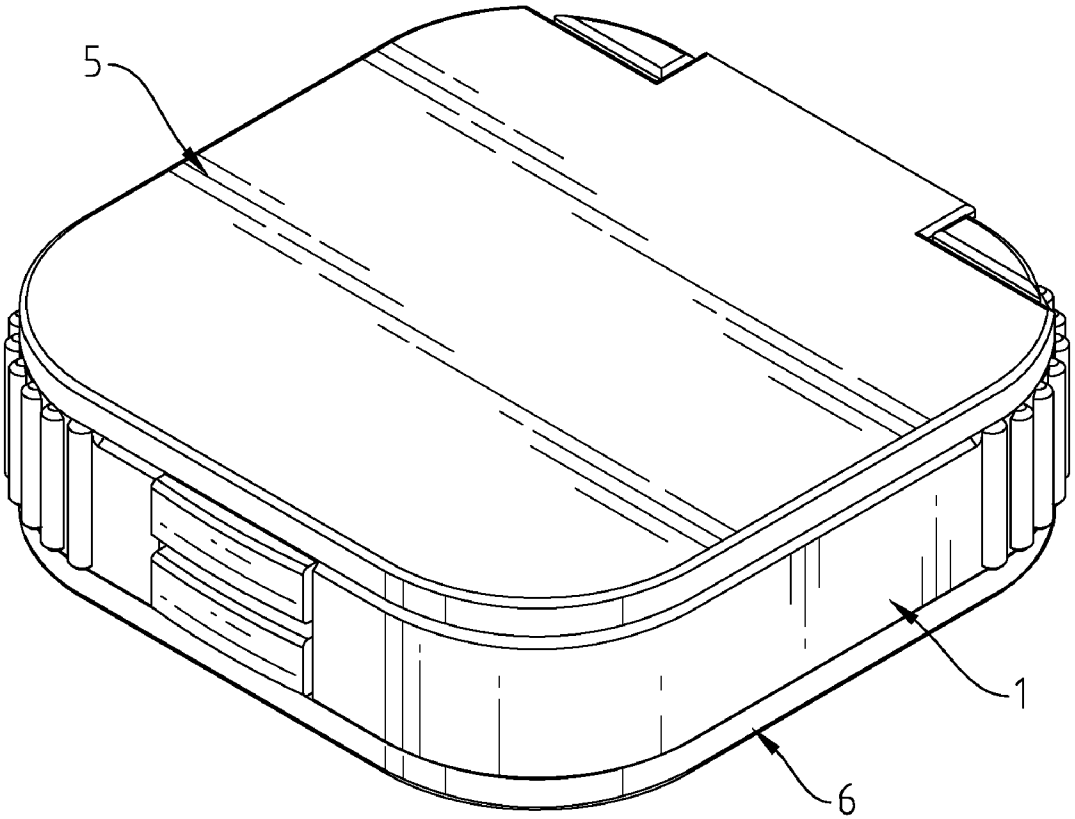
FIG. 1 is an oblique elevation of a bottle opener in accordance with the present invention.
Figure 2:
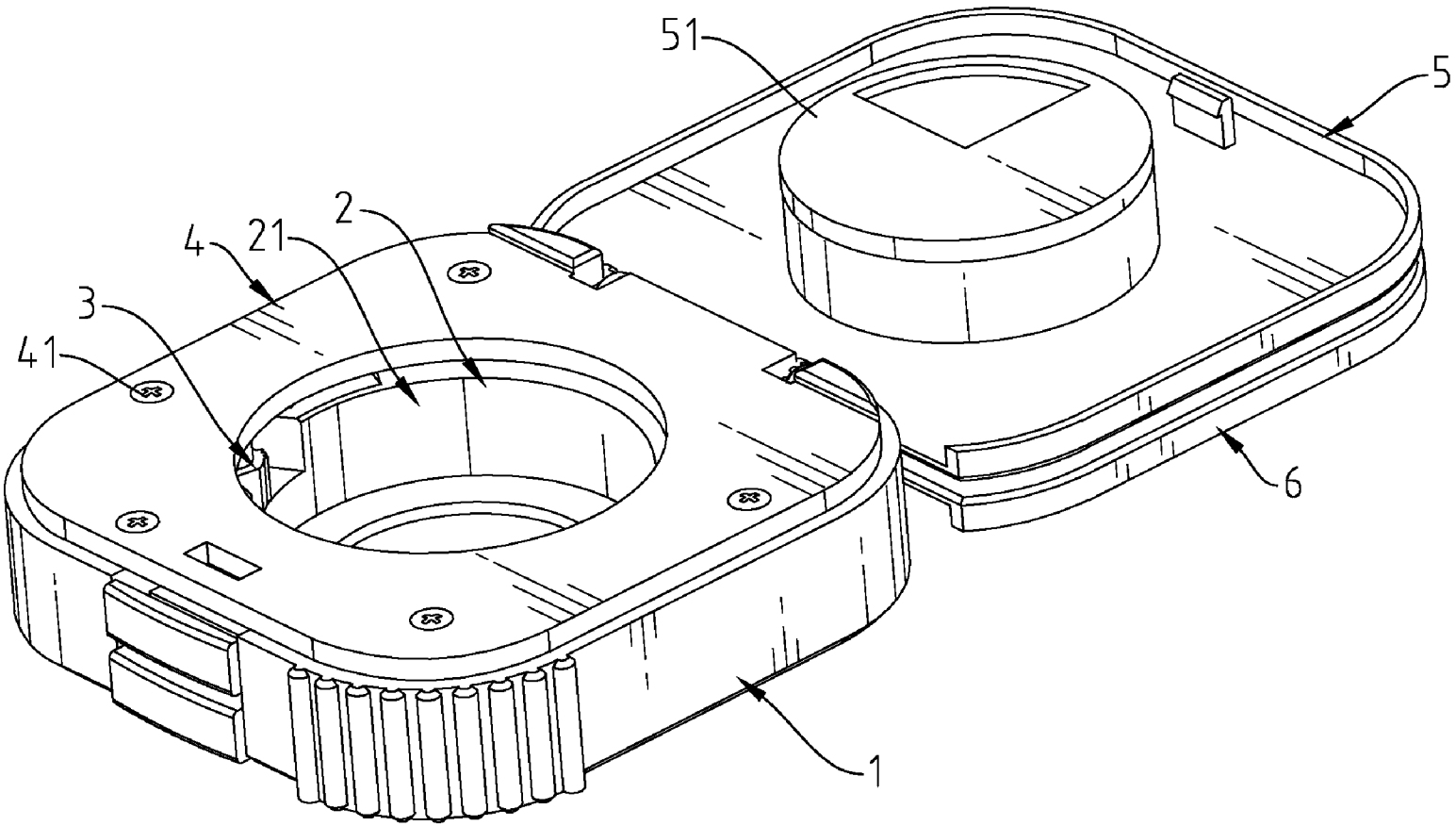
FIG. 2 is a perspective view of the present invention, showing the first side cover and second side cover of the bottle opener opened.
Figure 3:
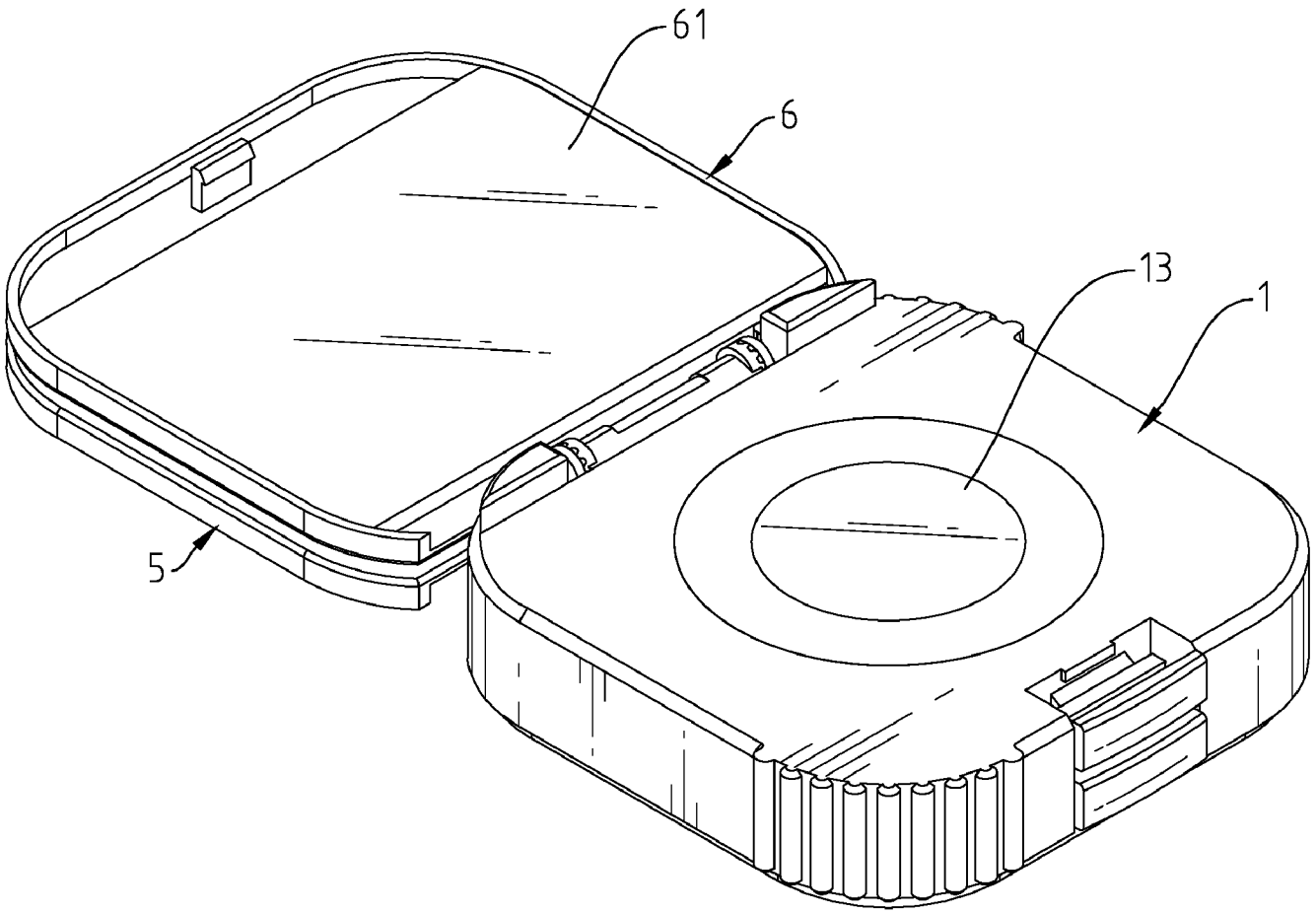
FIG. 3 is another perspective view of the present invention, showing the first side cover and second side cover of the bottle opener opened.
Figure 4:
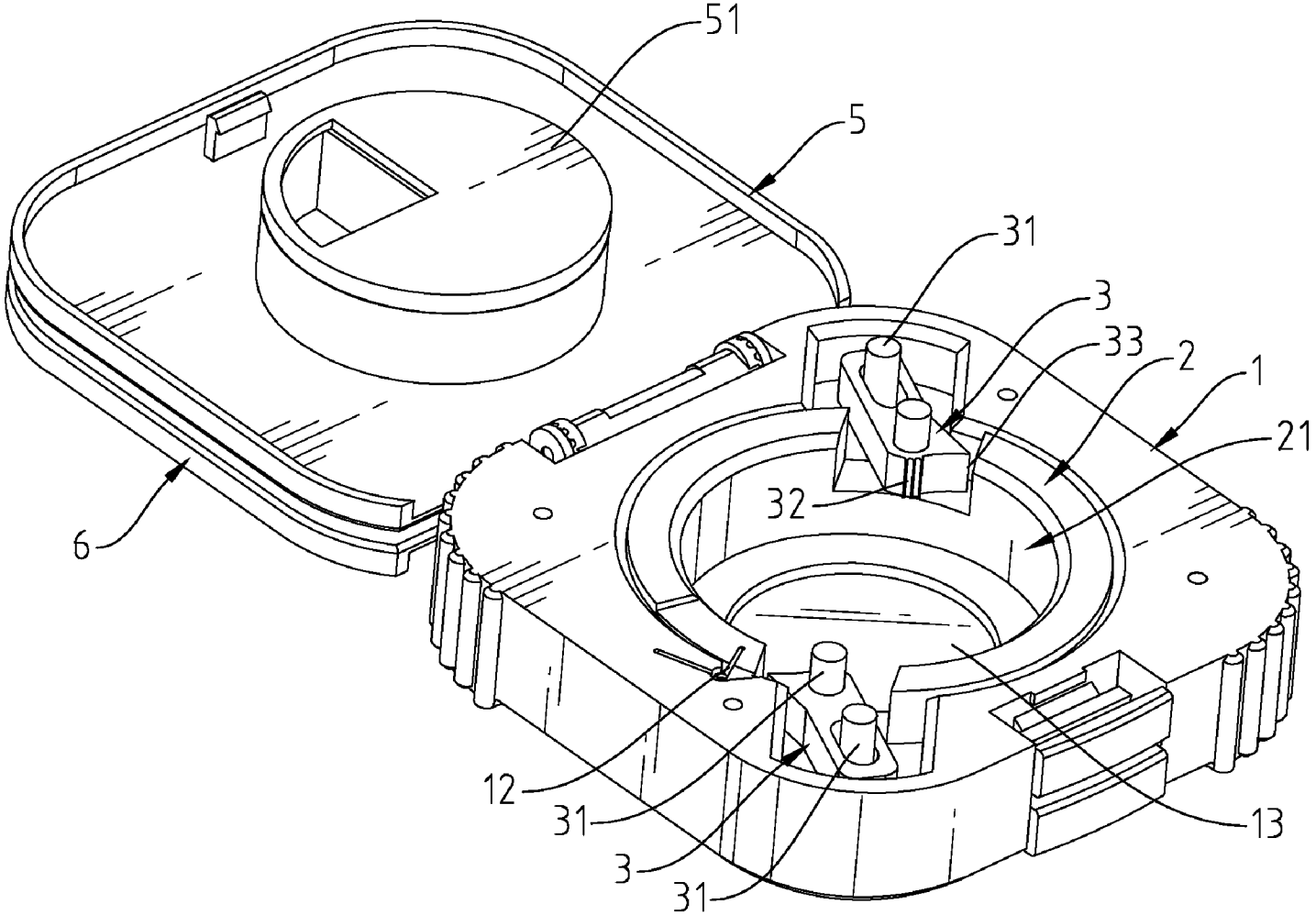
FIG. 4 is a perspective view of a part of the bottle opener in accordance with the present invention.
Figure 5:
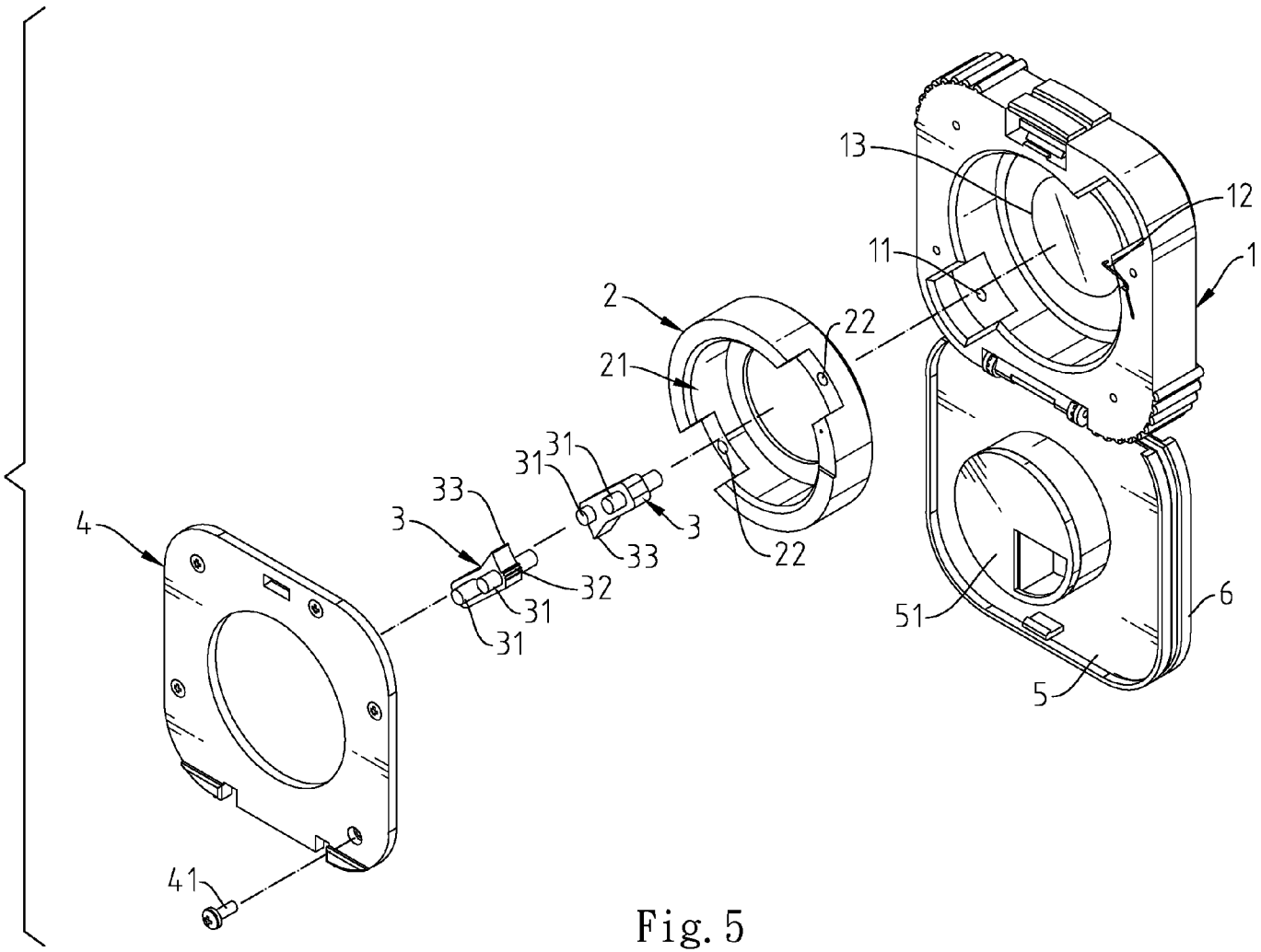
FIG. 5 is an exploded view of the bottle opener in accordance with the present invention.

Referring to FIGS. 1~5, a bottle opener in accordance with the present invention is shown comprising a base 1, an adapter 2, a plurality of retainers 3, a top cover 4, a first side cover 5 and a second side cover 6.

The adapter 2 has an open chamber 21. Further, the adapter 2 is pivotally mounted in the base 1. The base 1 has a plurality of first pivot holes 11 disposed adjacent to the periphery of the adapter 2. The adapter 2 has a plurality of second pivot holes 22 corresponding to the first pivot holes 11. The base 1 further has a spring member 12 fixedly mounted therein. The spring member 12 has its one end connected to the adapter 2. Further, a magnifying glass 13 is located on the open bottom side of the base 1 and aimed at the open chamber 21 of the adapter 2.

Each retainer 3 has two pivot pins 31 extended from the bottom side thereof and respectively pivotally connected to one first pivot hole 11 of the base 1 and one second pivot hole 22 of the adapter 2, a toothed portion 32 at one lateral side and a bearing portion 33 extended from one side of the toothed portion 32. The retaining rib 32 and bearing portion 33 are disposed adjacent to the open chamber 21 of the adapter 2.

The top cover 4 is affixed to the base 1 by fastening elements 41 to hold the adapter 2 and the retainers 3 in place.

The first side cover 5 and the second side cover 6 are respectively hinged to the base 1. The first side cover 5 can be closed on the surface of the top cover 4, having a storage box 51 located on the inner side thereof. The second side cover 6 can be closed on the bottom side of the base 1, having a mirror 61 located on the inner side thereof.

Figure 6:
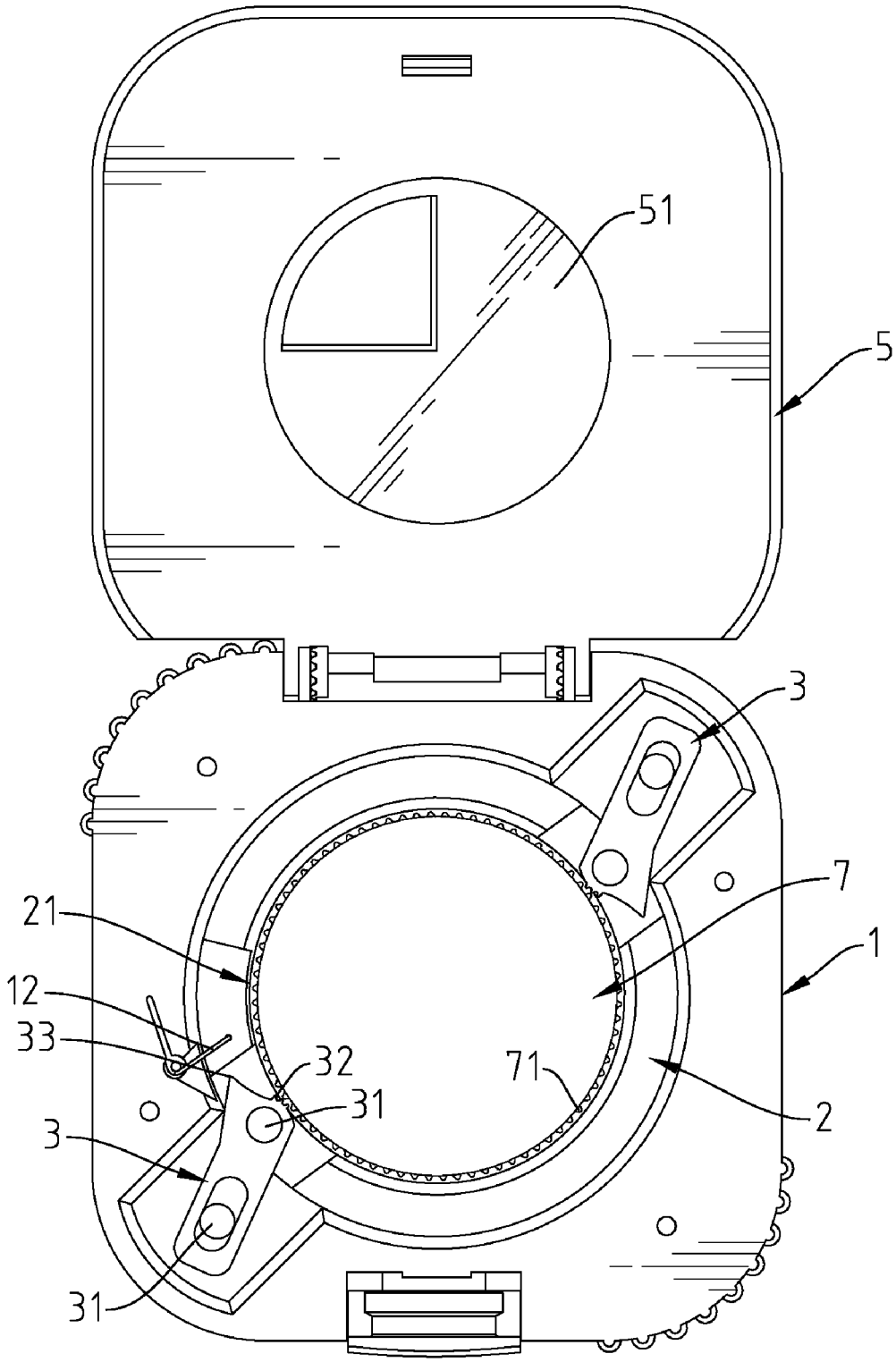
FIG. 6 is a schematic drawing of the present invention, showing an operation status of the bottle opener (I).
Figure 7:
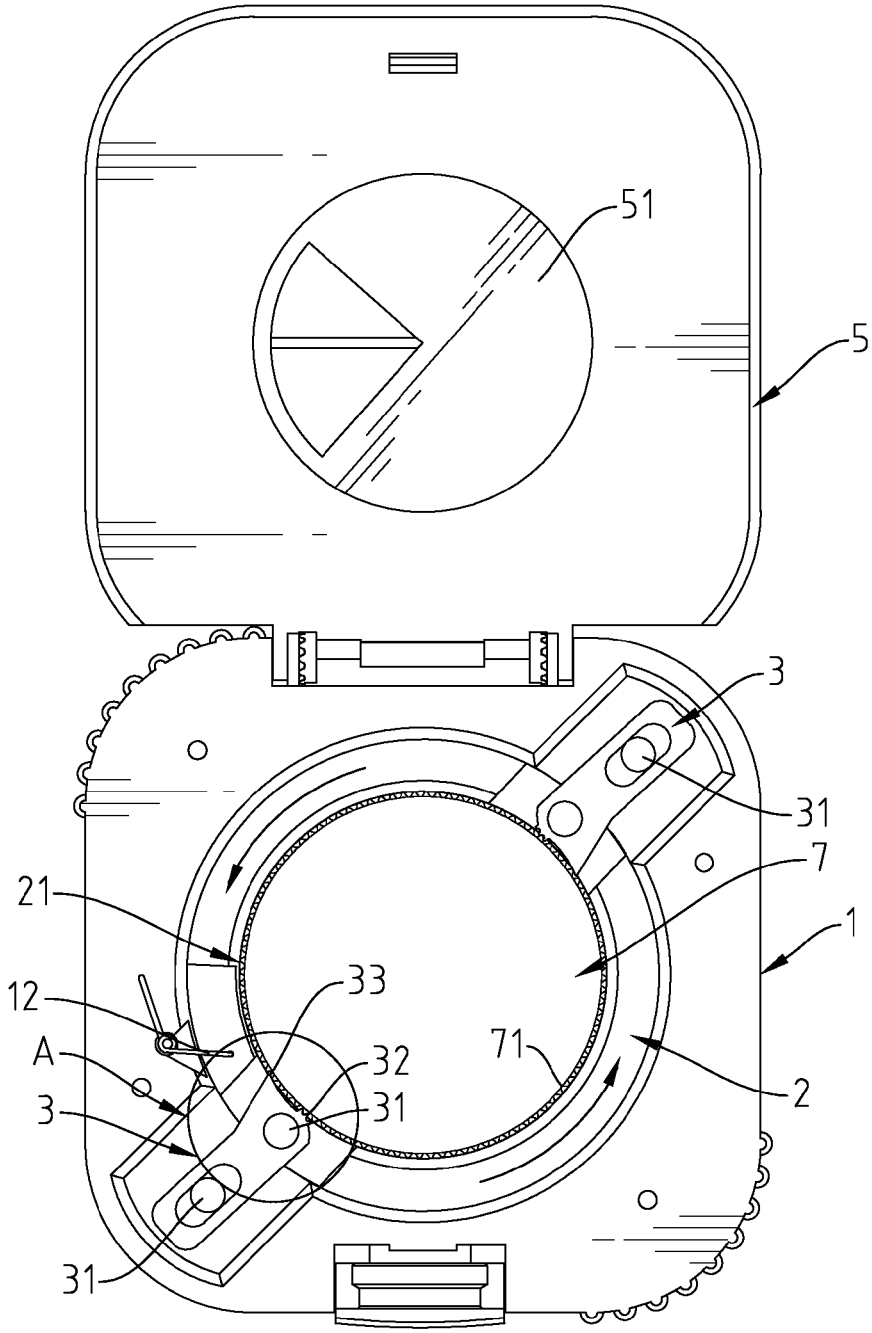
FIG. 7 is a schematic drawing of the present invention, showing an operation status of the bottle opener (II).
Figure 8:
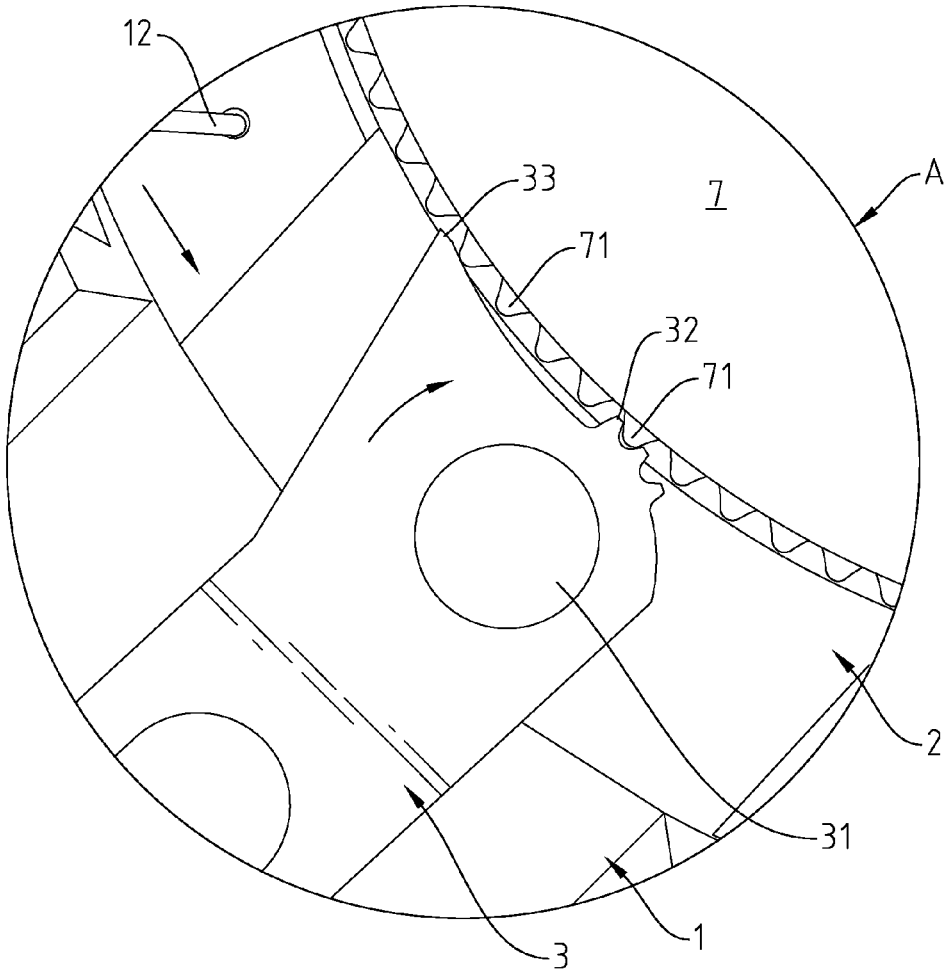
FIG. 8 is an enlarged view of part A of FIG. 7.

Referring to FIGS. 5~8, before use of the bottle opener, the adapter 2 receives no pressure, and the spring member 12 supports the adapter 2 at a predetermined angle relative to the base 1. As stated above, each retainer 3 has the two pivot pins 31 respectively pivotally connected to one first pivot hole 11 of the base 1 and one second pivot hole 22 of the adapter 2. After installation of the retainers 3, the toothed portions 32 of the retainers 3 project partially into the inside of the open chamber 21, and the bearing portions 33 of the retainers 3 are kept beyond the open chamber 21. At this time, the user can hold the base 1 and attach the adapter 2 to the cap 7 of the polyethylene terephthalate bottle to be opened, keeping the periphery cap 7 in the open chamber 21 and the toothed portion 32 in contact with the ribbed rim 71 of the cap 7 of the polyethylene terephthalate bottle. When the user rotates the base 1 relative to the polyethylene terephthalate bottle, the pivot pin 31 of each retainer 3 that is positioned in the respective second pivot hole 22 works as the fulcrum for enabling the pivot pin 31 of each retainer 3 that is positioned in the respective first pivot hole 11 to be biased with the base 1 relative to the adapter 2. Thus, the toothed portions 32 of the retainers 3 are forced inwards toward the inside of the open chamber 21 and stopped against the ribbed rim 71 of the cap 7 of the polyethylene terephthalate bottle to increase the friction force between the cap 7 and the retainers 3, and the bearing portions 33 of the retainers 3 are gradually moved toward the inside of the open chamber 21. When the bearing portions 33 are stopped against the ribbed rim 71 of the cap 7 of the polyethylene terephthalate bottle, the retainers 3 cannot be biased further. When continuously biasing the base 1 at this time, the toothed portions 32 of the retainers 3 will be forced to rotate the cap 7 of the polyethylene terephthalate bottle relative to the base 1, moving the cap 7 away from the polyethylene terephthalate bottle.

Further, when the base 1 is rotated relative to the adapter 2, the spring member 12 is elastically deformed to provide a return force. When the user opened the cap 7 from the polyethylene terephthalate bottle and removed the cap 7 from the open chamber 21, the friction force between the retainers 3 and the cap 7 is disappeared, enabling the spring member 12 to reverse the adapter 2 relative to the base 1 to its former position.

When wishing to open the cap 7 of the polyethylene terephthalate bottle, the adapter 2 is attached with the base 1 to the cap 7, and the base 1 is used as handle means to extend the arm of force, thereby enhancing the torque and enabling the user to open the cap 7 efficiently with less effort.

Further, if the cap 7 is excessively tightly fastened to the polyethylene terephthalate bottle and the user cannot open the cap 7 simply by means of rotating the base 1, the user can open the first side cover 5 and the second side cover 6 and then hold the first side cover 5 and the second side cover 6 and bias the first side cover 5 and the second side cover 6 relative to the polyethylene terephthalate bottle to enhance the torque and to open the cap 7 from the polyethylene terephthalate bottle.

Referring to FIGS. 2 and 3 again, the user can see through the open chamber 21 of the adapter 2 to view the magnifying glass 13. By means of the magnifying glass 13, the user can see a magnified image of the printed text of the polyethylene terephthalate bottle. Further, the user can use the storage box 51 to keep small items (for example, medicine tablets), facilitating carrying. Thus, the user can drink the drinking water from the polyethylene terephthalate bottle conveniently when taking the medicine. Further, the mirror 61 at the second side cover 6 facilitates the user to dress up.

Although a particular embodiment of the invention has been described in detail for purposes of illustration, various modifications and enhancements may be made without departing from the spirit and scope of the invention.

What is claimed is:

1. A bottle opener for opening polyethylene terephthalate bottles, comprising a base, an adapter pivotally mounted in said base, said adapter having an open chamber, and a plurality of retainers coupled between said base and said adapter and adapted for opening the cap of a polyethylene terephthalate bottle, wherein said base has a plurality of first pivot holes; said adapter has a plurality of second pivot holes; each said retainer has a first pivot pin and a second pivot pin extended from a bottom side thereof and respectively pivotally coupled to one said first pivot hole of said base and one said second pivot hole of said adapter, a toothed portion disposed at one lateral side thereof and a bearing portion extended from one side of said toothed portion, said toothed portion and said bearing portion being suspending in said open chamber of said adapter.

2. The bottle opener as claimed in claim 1, wherein said base has a spring member fixedly mounted therein, said spring member having one end thereof affixed to said base and an opposite end thereof connected to said adapter.

3. The bottle opener as claimed in claim 1, further comprising a top cover affixed to said base by fastening elements to hold said adapter and said retainers in said base.

4. The bottle opener as claimed in claim 1, further comprising a magnifying glass mounted in an open bottom side of said base and aimed at said open chamber of said adapter.

5. The bottle opener as claimed in claim 1, further comprising a top cover affixed to a top side of said base by fastening elements to hold said adapter and said retainers in said base, a first side cover hinged to one lateral side of said base and closable on said top cover, and a second side cover hinged to the same lateral side of said base and closable on a bottom side of said base opposite to said top cover.

6. The bottle opener as claimed in claim 5, wherein said first side cover has a storage box fixedly mounted on an inner side thereof; said second side cover has a mirror fixedly mounted on an inner side thereof.

* * * * *